US012055312B2

(12) United States Patent
Naoi et al.

(10) Patent No.: US 12,055,312 B2
(45) Date of Patent: Aug. 6, 2024

(54) AIR CONDITIONER

(71) Applicant: DAIKIN INDUSTRIES, LTD., Osaka (JP)

(72) Inventors: Takehiro Naoi, Osaka (JP); Yuta Fukuyama, Osaka (JP); Takaya Nakanishi, Osaka (JP); Ryuuta Ohura, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/387,260

(22) Filed: Nov. 6, 2023

(65) Prior Publication Data

US 2024/0068695 A1 Feb. 29, 2024

Related U.S. Application Data

(63) Continuation of application No. PCT/JP2022/019573, filed on May 6, 2022.

(30) Foreign Application Priority Data

May 7, 2021 (JP) ..... 2021-079359

(51) Int. Cl.
*F24F 11/67* (2018.01)

(52) U.S. Cl.
CPC ..... *F24F 11/67* (2018.01)

(58) Field of Classification Search
CPC ..... F24F 11/67; F25B 2600/25; F25B 2600/2513; F25B 2600/2515; F25B 2700/2104
See application file for complete search history.

(56) References Cited

U.S. PATENT DOCUMENTS

2015/0052922 A1* 2/2015 Tanaka ..... F24F 11/30 62/210
2020/0064040 A1* 2/2020 Koike ..... F25B 49/022

FOREIGN PATENT DOCUMENTS

JP 2-3093 A 1/1990
JP 4-251158 A 9/1992
(Continued)

OTHER PUBLICATIONS

International Search Report (PCT/ISA/210) issued in PCT/JP2022/019573, dated Jul. 12, 2022.
(Continued)

*Primary Examiner* — Marc E Norman
(74) *Attorney, Agent, or Firm* — Birch, Stewart, Kolasch & Birch, LLP

(57) ABSTRACT

An air conditioner includes an indoor unit, an outdoor unit, an outdoor expansion valve, an indoor expansion valve, and a controller. The controller executes first control and second control. The first control includes stopping cooling operation or heating operation if a first condition is satisfied during cooling operation or heating operation, and then starting cooling operation or heating operation if a second condition is satisfied. The first condition indicates that a heat load in a target space is low. The second condition relates to the heat load in the target space. The second control includes setting opening degrees of the outdoor expansion valve and the indoor expansion valve upon a start of cooling operation or heating operation according to the first control to be larger than opening degrees upon satisfaction of the first condition.

5 Claims, 5 Drawing Sheets

(56) References Cited

FOREIGN PATENT DOCUMENTS

| | | | |
|---|---|---|---|
| JP | 10-238867 | A | 9/1998 |
| JP | 2006-118764 | A | 5/2006 |
| JP | 2007-178051 | A | 7/2007 |
| JP | 2008-286464 | A | 11/2008 |
| JP | 2016-138711 | A | 8/2016 |
| JP | 2018-128158 | A | 8/2018 |
| JP | 2020-51700 | A | 4/2020 |

OTHER PUBLICATIONS

International Preliminary Report on Patentability and English translation of the Written Opinion of the International Searching Authority for International Application No. PCT/JP2022/019573, dated Nov. 16, 2023.

* cited by examiner

AIR CONDITIONER

CROSS REFERENCE TO RELATED APPLICATIONS

This application is a Continuation of PCT International Application No. PCT/JP2022/019573, filed on May 6, 2022, which claims priority under 35 U.S.C. § 119(a) to Patent Application No. JP 2021-079359, filed in Japan on May 7, 2021, all of which are hereby expressly incorporated by reference into the present application.

TECHNICAL FIELD

The present disclosure relates to an air conditioner.

BACKGROUND ART

As disclosed in Patent Literature 1 (JP 2020-051700 A), there has been proposed a technique of stopping ongoing cooling operation or heating operation when a heat load in a target space decreases, and then starting cooling operation or heating operation in accordance with the heat load in the target space.

SUMMARY

An air conditioner according to a first aspect includes an indoor unit, an outdoor unit, a flow rate control mechanism, and a control unit. The indoor unit is disposed in a target space of air conditioning. The outdoor unit is disposed outside the target space. The flow rate control mechanism controls a flow rate of a refrigerant. The control unit executes cooling operation or heating operation, first control, and second control. Cooling operation or heating operation includes circulating the refrigerant in the indoor unit and the outdoor unit to approach room temperature in the target space to set temperature. The first control includes stopping cooling operation or heating operation if a first condition is satisfied during cooling operation or heating operation, and then starting cooling operation or heating operation if a second condition is satisfied. The first condition indicates that a heat load in the target space is low. The second condition relates to the heat load in the target space. The second control includes setting an opening degree of the flow rate control mechanism upon a start of cooling operation or heating operation according to the first control to be larger than an opening degree upon satisfaction of the first condition.

DESCRIPTION OF EMBODIMENTS (1) Entire Configuration

Figure 1:
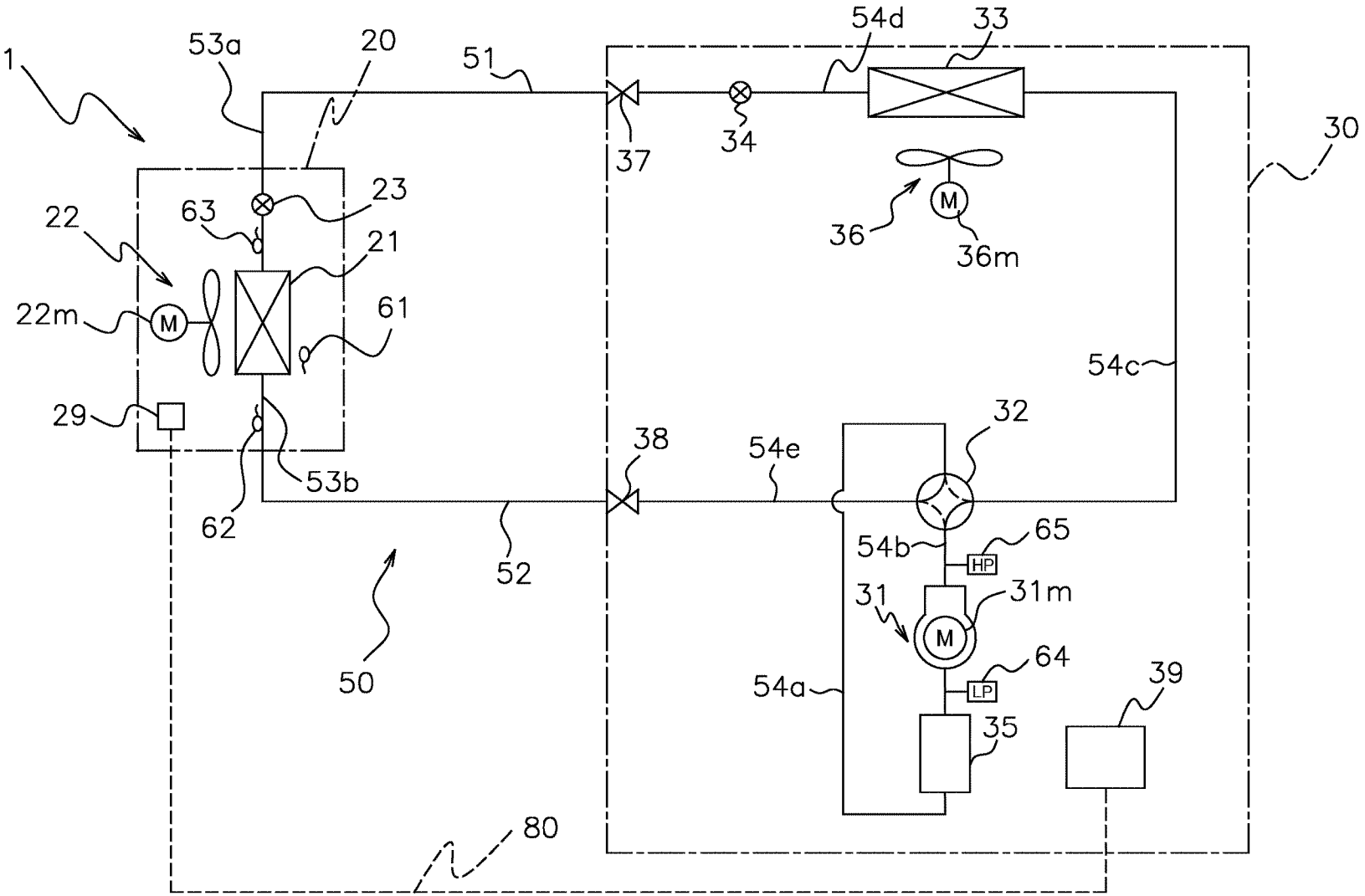
FIG. 1 is a diagram depicting a refrigerant circuit of an air conditioner.

An air conditioner 1 achieves a vapor compression refrigeration cycle to cool or heat a target space. The air conditioner 1 according to the present embodiment is a so-called multiple air conditioning system for buildings. FIG. 1 is a diagram depicting a refrigerant circuit 50 of the air conditioner 1. As depicted in FIG. 1, the air conditioner 1 principally includes an indoor unit 20 and an outdoor unit 30. The indoor unit 20 and the outdoor unit 30 are connected via a liquid-refrigerant connection pipe 51 and a gas-refrigerant connection pipe 52 to constitute the refrigerant circuit 50. The indoor unit 20 and the outdoor unit 30 are communicably connected by a communication line 80.

(2) Detailed Configurations (2-1) Indoor Unit

The indoor unit 20 is disposed in the target space of air conditioning, such as in a room of a building provided with the air conditioner 1. The indoor unit 20 is a ceiling embedded unit, a ceiling pendant unit, a floorstanding unit, or the like. As depicted in FIG. 1, the indoor unit 20 principally includes an indoor expansion valve 23 (flow rate control mechanism) and an indoor control unit 29. The indoor unit 20 further includes an indoor heat exchanger 21, an indoor fan 22, an indoor temperature sensor 61, a gas-side temperature sensor 62, and a liquid-side temperature sensor 63. The indoor unit 20 also includes a liquid refrigerant pipe 53*a* connecting a liquid side end of the indoor heat exchanger 21 and the liquid-refrigerant connection pipe 51, and a gas refrigerant pipe 53*b* connecting a gas side end of the indoor heat exchanger 21 and the gas-refrigerant connection pipe 52.

(2-1-1) Indoor Heat Exchanger

The indoor heat exchanger 21 should not be limited in terms of its structure, and examples thereof include a fin-and-tube heat exchanger of a cross-fin type including a heat transfer tube (not depicted) and a large number of fins (not depicted). The indoor heat exchanger 21 causes heat exchange between a refrigerant flowing in the indoor heat exchanger 21 and air in the target space.

The indoor heat exchanger 21 functions as an evaporator during cooling operation and functions as a condenser during heating operation.

(2-1-2) Indoor Fan

The indoor fan 22 sucks air in the target space into the indoor unit 20, supplies the sucked air to the indoor heat exchanger 21, and supplies air obtained through heat exchange with the refrigerant in the indoor heat exchanger 21 to the target space. Examples of the indoor fan 22 include a centrifugal fan such as a turbo fan or a sirocco fan. The indoor fan 22 is driven by an indoor fan motor 22*m*. The indoor fan motor 22*m* has a rotation frequency controllable by means of an inverter.

(2-1-3) Indoor Expansion Valve

The indoor expansion valve 23 is configured to control pressure and a flow rate of the refrigerant flowing in the liquid refrigerant pipe 53*a*. The indoor expansion valve 23 is provided on the liquid refrigerant pipe 53*a*. The indoor expansion valve 23 according to the present embodiment is an electronic expansion valve having a controllable opening degree.

(2-1-4) Sensors

The indoor temperature sensor 61 measures air temperature (room temperature) of the target space. The indoor temperature sensor 61 is provided adjacent to an air suction port of the indoor unit 20.

The gas-side temperature sensor 62 measures temperature of the refrigerant flowing in the gas refrigerant pipe 53*b*. The gas-side temperature sensor 62 is provided on the gas refrigerant pipe 53*b*.

The liquid-side temperature sensor 63 measures temperature of the refrigerant flowing in the liquid refrigerant pipe 53*a*. The liquid-side temperature sensor 63 is provided on the liquid refrigerant pipe 53*a*.

Examples of the indoor temperature sensor 61, the gas-side temperature sensor 62, and the liquid-side temperature sensor 63 include a thermistor.

(2-1-5) Indoor Control Unit

The indoor control unit 29 controls behavior of respective parts constituting the indoor unit 20.

The indoor control unit 29 is electrically connected to various devices included in the indoor unit 20, such as the indoor expansion valve 23 and the indoor fan motor 22*m*. The indoor control unit 29 is communicably connected to various sensors provided in the indoor unit 20, such as the indoor temperature sensor 61, the gas-side temperature sensor 62, and the liquid-side temperature sensor 63.

The indoor control unit 29 includes a control arithmetic device and a storage device. Examples of the control arithmetic device include a processor such as a CPU or a GPU. Examples of the storage device include a storage medium such as a RAM, a ROM, or a flash memory. The control arithmetic device reads a program stored in the storage device and executes predetermined arithmetic processing in accordance with the program, to control behavior of the respective parts constituting the indoor unit 20. The control arithmetic device is further configured to write an arithmetic result to the storage device, and read information stored in the storage device, in accordance with the program. The indoor control unit 29 includes a timer.

The indoor control unit 29 is configured to receive various signals transmitted from an operation remote controller (not depicted). Examples of the various signals include signals for commanding a start and a stop of operation, and signals relevant to various settings. Examples of the signals relevant to the various settings include a signal relevant to set temperature or set humidity. The indoor control unit 29 transmits and receives to and from an outdoor control unit 39 of the outdoor unit 30, via the communication line 80, control signals, measurement signals, signals relevant to the various settings, and the like.

The indoor control unit 29 and the outdoor control unit 39 cooperate with each other to function as a control unit 70. The control unit 70 will be described in detail later in terms of its function.

(2-2) Outdoor Unit

The outdoor unit 30 is disposed outside the target space such as on a roof of the building provided with the air conditioner 1. As depicted in FIG. 1, the outdoor unit 30 principally includes an outdoor expansion valve 34 (flow rate control mechanism) and the outdoor control unit 39. The outdoor unit 30 further includes a compressor 31, a flow direction switching mechanism 32, an outdoor heat exchanger 33, an accumulator 35, an outdoor fan 36, a liquid-side shutoff valve 37, a gas-side shutoff valve 38, a suction pressure sensor 64, and a discharge pressure sensor 65. The outdoor unit 30 also includes a suction tube 54*a*, a discharge tube 54*b*, a first gas refrigerant tube 54*c*, a liquid refrigerant tube 54*d*, and a second gas refrigerant tube 54*e*.

As depicted in FIG. 1, the suction tube 54*a* connects the flow direction switching mechanism 32 and a suction side of the compressor 31. The suction tube 54*a* is provided with the accumulator 35. The discharge tube 54*b* connects a discharge side of the compressor 31 and the flow direction switching mechanism 32. The first gas refrigerant tube 54*c* connects the flow direction switching mechanism 32 and a gas side of the outdoor heat exchanger 33. The liquid refrigerant tube 54*d* connects a liquid side of the outdoor heat exchanger 33 and the liquid-refrigerant connection pipe 51. The liquid refrigerant tube 54*d* is provided with the outdoor expansion valve 34. The liquid refrigerant tube 54*d* and the liquid-refrigerant connection pipe 51 are connected at a portion provided with the liquid-side shutoff valve 37. The second gas refrigerant tube 54*e* connects the flow direction switching mechanism 32 and the gas-refrigerant connection pipe 52. The second gas refrigerant tube 54*e* and the gas-refrigerant connection pipe 52 are connected at a portion provided with the gas-side shutoff valve 38.

(2-2-1) Compressor

As depicted in FIG. 1, the compressor 31 is configured to suck a low-pressure refrigerant in the refrigeration cycle from the suction tube 54*a*, compress the refrigerant by means of a compression mechanism (not depicted), and discharge the compressed refrigerant to the discharge tube 54*b*.

The compressor 31 is configured as a displacement compressor of a rotary type or a scroll type. The compressor 31 includes the compression mechanism driven by a compressor motor 31*m*. The compressor motor 31*m* has a rotation frequency controllable by means of an inverter.

(2-2-2) Flow Direction Switching Mechanism

The flow direction switching mechanism 32 is configured to switch a refrigerant flow path between a first state and a second state. The flow direction switching mechanism 32 in the first state causes the suction tube 54*a* to communicate with the second gas refrigerant tube 54*e*, and causes the discharge tube 54*b* to communicate with the first gas refrigerant tube 54*c*, as indicated by solid lines in the flow direction switching mechanism 32 depicted in FIG. 1. The flow direction switching mechanism 32 in the second state causes the suction tube 54*a* to communicate with the first gas refrigerant tube 54*c*, and causes the discharge tube 54*b* to communicate with the second gas refrigerant tube 54*e*, as indicated by broken lines in the flow direction switching mechanism 32 depicted in FIG. 1.

During cooling operation, the flow direction switching mechanism 32 brings the refrigerant flow path into the first state. In this case, the refrigerant discharged from the compressor 31 flows in the refrigerant circuit 50 through the outdoor heat exchanger 33, the outdoor expansion valve 34, the indoor expansion valve 23, and the indoor heat exchanger 21 in the mentioned order, to return to the compressor 31. In the first state, the outdoor heat exchanger 33 functions as a condenser and the indoor heat exchanger 21 functions as an evaporator.

During heating operation, the flow direction switching mechanism 32 brings the refrigerant flow path into the second state. In this case, the refrigerant discharged from the compressor 31 flows in the refrigerant circuit 50 through the indoor heat exchanger 21, the indoor expansion valve 23, the outdoor expansion valve 34, and the outdoor heat exchanger 33 in the mentioned order, to return to the compressor 31. In the second state, the outdoor heat exchanger 33 functions as an evaporator and the indoor heat exchanger 21 functions as a condenser.

(2-2-3) Outdoor Heat Exchanger

The outdoor heat exchanger 33 causes heat exchange between the refrigerant flowing in the outdoor heat exchanger 33 and outdoor air. The outdoor heat exchanger 33 should not be limited in terms of its structure, and examples thereof include a fin-and-tube heat exchanger of a cross-fin type including a heat transfer tube (not depicted) and a large number of fins (not depicted).

(2-2-4) Outdoor Expansion Valve

The outdoor expansion valve 34 is a mechanism configured to control pressure and a flow rate of the refrigerant flowing in the liquid refrigerant tube 54*d*. The outdoor expansion valve 34 according to the present embodiment is an electronic expansion valve having a controllable opening degree.

(2-2-5) Accumulator

The accumulator 35 is a container having a gas-liquid separation function of separating an incoming refrigerant into a gas refrigerant and a liquid refrigerant. A refrigerant flowing into the accumulator 35 is separated into a gas refrigerant and a liquid refrigerant, and the gas refrigerant collecting in an upper space flows into the compressor 31.

(2-2-6) Outdoor Fan

The outdoor fan 36 is configured to suck outdoor air into the outdoor unit 30, supply the sucked outdoor air to the outdoor heat exchanger 33, and discharge outdoor air having exchanged heat with a refrigerant in the outdoor heat exchanger 33 to outside the outdoor unit 30. Examples of the outdoor fan 36 include an axial fan such as a propeller fan. The outdoor fan 36 is driven by an outdoor fan motor 36*m*. The outdoor fan motor 36*m* has a rotation frequency controllable by means of an inverter.

(2-2-7) Sensors

The suction pressure sensor 64 is configured to measure suction pressure. The suction pressure sensor 64 is provided on the suction tube 54*a*. Suction pressure has a low pressure value in a refrigeration cycle.

The discharge pressure sensor 65 is configured to measure discharge pressure. The discharge pressure sensor 65 is provided on the discharge tube 54*b*. Discharge pressure has a high pressure value in a refrigeration cycle.

(2-2-8) Liquid-Side Shutoff Valve and Gas-Side Shutoff Valve

As depicted in FIG. 1, the liquid-side shutoff valve 37 is provided at a portion connecting the liquid refrigerant tube 54*d* and the liquid-refrigerant connection pipe 51. The gas-side shutoff valve 38 is provided at a portion connecting the second gas refrigerant tube 54*e* and the gas-refrigerant connection pipe 52. The liquid-side shutoff valve 37 and the gas-side shutoff valve 38 are exemplarily configured to be operated manually.

(2-2-9) Outdoor Control Unit

The outdoor control unit 39 controls behavior of respective parts constituting the outdoor unit 30.

The outdoor control unit 39 is electrically connected to various devices included in the outdoor unit 30, such as the compressor motor 31*m*, the flow direction switching mechanism 32, the outdoor expansion valve 34, and the outdoor fan motor 36*m*. The outdoor control unit 39 is communicably connected to various sensors provided in the outdoor unit 30, such as the suction pressure sensor 64 and the discharge pressure sensor 65.

The outdoor control unit 39 includes a control arithmetic device and a storage device. Examples of the control arithmetic device include a processor such as a CPU or a GPU. Examples of the storage device include a storage medium such as a RAM, a ROM, or a flash memory. The control arithmetic device reads a program stored in the storage device and executes predetermined arithmetic processing in accordance with the program, to control behavior of the respective parts constituting the outdoor unit 30. The control arithmetic device is further configured to write an arithmetic result to the storage device, and read information stored in the storage device, in accordance with the program. The outdoor control unit 39 includes a timer.

The outdoor control unit 39 transmits and receives to and from the indoor control unit 29 of the indoor unit 20, via the communication line 80, control signals, measurement signals, signals relevant to the various settings, and the like.

The outdoor control unit 39 and the indoor control unit 29 cooperate with each other to function as the control unit 70. The control unit 70 will be described in detail later in terms of its function.

(2-3) Control Unit

The control unit 70 includes the indoor control unit 29 and the outdoor control unit 39 communicably connected via the communication line 80. In other words, the indoor control unit 29 and the outdoor control unit 39 cooperate with each other to function as the control unit 70 configured to control behavior of the air conditioner 1.

Figure 2:
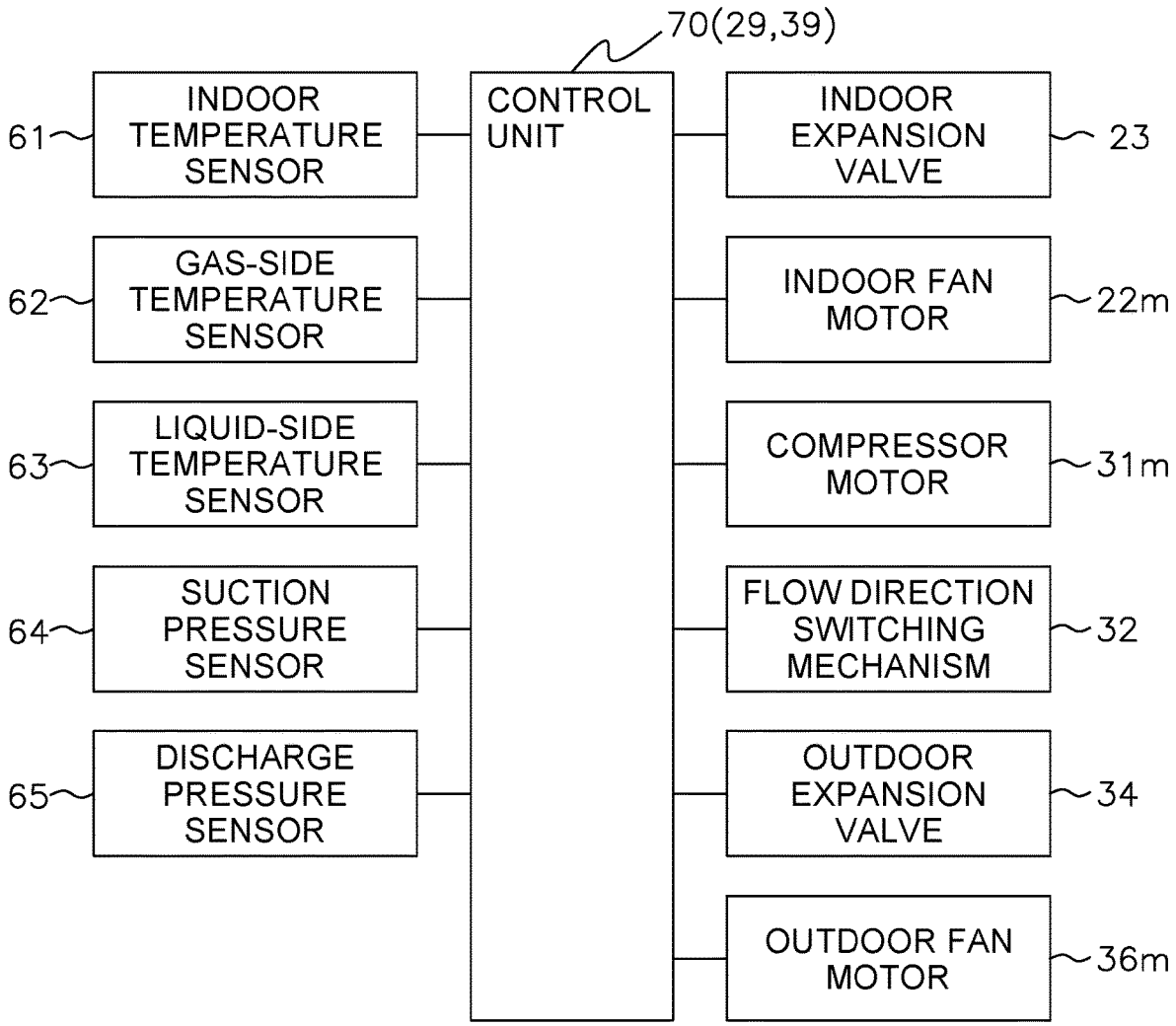
FIG. 2 is a control block diagram of the air conditioner.

FIG. 2 is a control block diagram of the air conditioner 1. As depicted in FIG. 2, the control unit 70 is communicably connected to the indoor temperature sensor 61, the gas-side temperature sensor 62, the liquid-side temperature sensor 63, the suction pressure sensor 64, and the discharge pressure sensor 65. The control unit 70 receives measurement signals transmitted from the various sensors. The control unit 70 is electrically connected to the indoor expansion valve 23, the indoor fan motor 22*m*, the compressor motor 31*m*, the flow direction switching mechanism 32, the outdoor expansion valve 34, and the outdoor fan motor 36*m*. The control unit 70 controls behavior of various devices in the air conditioner 1, such as the indoor expansion valve 23, the indoor fan motor 22*m*, the compressor motor 31*m*, the flow direction switching mechanism 32, the outdoor expansion valve 34, and the outdoor fan motor 36*m*, in accordance with the measurement signals from the various sensors, in response to a control signal transmitted from the operation remote controller.

The control unit 70 principally executes cooling operation or heating operation, first control, and second control.

(2-3-1) Cooling Operation

Upon receipt of a command to cause the indoor unit 20 to execute cooling operation from the operation remote controller, the control unit 70 controls the flow direction switching mechanism 32 to bring the interior of the flow direction switching mechanism 32 into the state indicated by the solid lines in FIG. 1. The refrigerant flow path comes into the first state in this case.

The control unit 70 opens the outdoor expansion valve 34 stepwise, and also controls the opening degree of the indoor expansion valve 23 such that the refrigerant at a gas side outlet of the indoor heat exchanger 21 has a predetermined target degree of superheating. The degree of superheating of the refrigerant at the gas side outlet of the indoor heat exchanger 21 can be exemplarily calculated by subtracting evaporation temperature converted from a measurement value (suction pressure) of the suction pressure sensor 64 from a measurement value of the gas-side temperature sensor 62.

The control unit 70 controls operating capacity of the compressor 31 such that the evaporation temperature converted from the measurement value of the suction pressure sensor 64 approaches predetermined target evaporation temperature. Controlling the operating capacity of the compressor 31 is achieved by controlling the rotation frequency of the compressor motor 31*m*.

As described above, when the control unit 70 controls various devices such as the compressor 31, the outdoor expansion valve 34, and the indoor expansion valve 23 in order to approach room temperature in the target space to set temperature, the refrigerant flows as follows in the refrigerant circuit 50 during cooling operation.

When the compressor 31 is activated, a low-pressure gas refrigerant in the refrigeration cycle is sucked into the compressor 31 and is compressed by the compressor 31 into a high-pressure gas refrigerant in the refrigeration cycle.

The high-pressure gas refrigerant passes the flow direction switching mechanism 32 and flows in the first gas refrigerant tube 54*c* to be sent to the outdoor heat exchanger 33. The high-pressure gas refrigerant sent to the outdoor heat exchanger 33 exchanges heat with outdoor air supplied by the outdoor fan 36 to be condensed into a high-pressure liquid refrigerant. The high-pressure liquid refrigerant having passed the outdoor heat exchanger 33 flows in the liquid refrigerant tube 54*d* and passes the outdoor expansion valve 34 to be sent to the indoor unit 20.

The high-pressure liquid refrigerant sent to the indoor unit 20 is decompressed at the indoor expansion valve 23 to have pressure close to suction pressure of the compressor 31 and come into a refrigerant in a gas-liquid two-phase state, and is sent to the indoor heat exchanger 21. The refrigerant in the gas-liquid two-phase state exchanges heat, in the indoor heat exchanger 21, with air in the target space supplied into the indoor heat exchanger 21 by the indoor fan 22 to be evaporated into a low-pressure gas refrigerant. The low-pressure gas refrigerant is sent to the outdoor unit 30 via the gas-refrigerant connection pipe 52, and flows into the accumulator 35 via the flow direction switching mechanism 32. The low-pressure gas refrigerant thus entered the accumulator 35 is sucked into the compressor 31 again. Air supplied into the indoor heat exchanger 21 is decreased in temperature through heat exchange with the refrigerant flowing in the indoor heat exchanger 21. Accordingly, air cooled in the indoor heat exchanger 21 blows into the target space.

(2-3-2) Heating Operation

Upon receipt of a command to cause the indoor unit 20 to execute heating operation from the operation remote controller, the control unit 70 controls the flow direction switching mechanism 32 to bring the interior of the flow direction switching mechanism 32 into the state indicated by the broken lines in FIG. 1. The refrigerant flow path comes into the second state in this case.

The control unit 70 controls the opening degree of the indoor expansion valve 23 such that the refrigerant at a liquid side outlet of the indoor heat exchanger 21 has a predetermined target degree of subcooling. The degree of subcooling of the refrigerant at the liquid side outlet of the indoor heat exchanger 21 can be exemplarily calculated by subtracting a measurement value of the liquid-side temperature sensor 63 from condensation temperature converted from a measurement value (discharge pressure) of the discharge pressure sensor 65.

The control unit 70 controls the opening degree of the outdoor expansion valve 34 such that the refrigerant flowing into the outdoor heat exchanger 33 is decompressed to have pressure allowing evaporation in the outdoor heat exchanger 33.

The control unit 70 controls the operating capacity of the compressor 31 such that the condensation temperature converted from the measurement value of the discharge pressure sensor 65 approaches predetermined target condensation temperature. Controlling the operating capacity of the compressor 31 is achieved by controlling the rotation frequency of the compressor motor 31*m*.

As described above, when the control unit 70 controls various devices such as the compressor 31, the outdoor expansion valve 34, and the indoor expansion valve 23 in order to approach room temperature in the target space to set temperature, the refrigerant flows as follows in the refrigerant circuit 50 during heating operation.

When the compressor 31 is activated, a low-pressure gas refrigerant in the refrigeration cycle is sucked into the compressor 31 and is compressed by the compressor 31 into a high-pressure gas refrigerant in the refrigeration cycle. The high-pressure gas refrigerant is sent to the indoor heat exchanger 21 via the flow direction switching mechanism 32, and exchanges heat with air in the target space supplied by the indoor fan 22 to be condensed into a high-pressure liquid refrigerant. Air supplied into the indoor heat exchanger 21 is increased in temperature through heat exchange with the refrigerant flowing in the indoor heat exchanger 21. Accordingly, air heated in the indoor heat exchanger 21 blows into the target space. The high-pressure liquid refrigerant having passed the indoor heat exchanger 21 passes the indoor expansion valve 23 to be decompressed. The refrigerant thus decompressed at the indoor expansion valve 23 is sent to the outdoor unit 30 via the liquid-refrigerant connection pipe 51, and flows into the liquid refrigerant tube 54*d*. The refrigerant flowing in the liquid refrigerant tube 54*d* is decompressed, while passing the outdoor expansion valve 34, to have pressure close to the suction pressure of the compressor 31 and come into a refrigerant in the gas-liquid two-phase state, and flows into the outdoor heat exchanger 33. The low-pressure gas refrigerant in the gas-liquid two-phase state thus entered the outdoor heat exchanger 33 exchanges heat with outdoor air supplied by the outdoor fan 36 to be evaporated into a low-pressure gas refrigerant. The low-pressure gas refrigerant flows into the accumulator 35 via the flow direction switching mechanism 32. The low-pressure gas refrigerant thus entered the accumulator 35 is sucked into the compressor 31 again.

(2-3-3) First Control

The control unit 70 executes the first control of stopping cooling operation or heating operation if a first condition is satisfied during cooling operation or heating operation. The first condition indicates that the target space has a low heat load. The first condition according to the present embodiment is based on a temperature difference between set temperature and room temperature. Specifically, the first condition during cooling operation according to the present embodiment is satisfied if room temperature is less than set temperature by at least one degree. The first condition during heating operation according to the present embodiment is satisfied if room temperature is more than set temperature by at least one degree.

The control unit 70 stops cooling operation or heating operation when the first condition is satisfied, and then starts cooling operation or heating operation if a second condition is satisfied. The second condition relates to the heat load in the target space. The second condition according to the present embodiment is based on the temperature difference between set temperature and room temperature. Specifically, the second condition during cooling operation according to the present embodiment is satisfied if room temperature is more than set temperature by at least one degree. The second condition during heating operation according to the present embodiment is satisfied if room temperature is less than set temperature by at least one degree.

Description is made below to behavior of various devices upon the first control during each of cooling operation and heating operation.

(2-3-3-1) First Control During Cooling Operation

Figure 3:
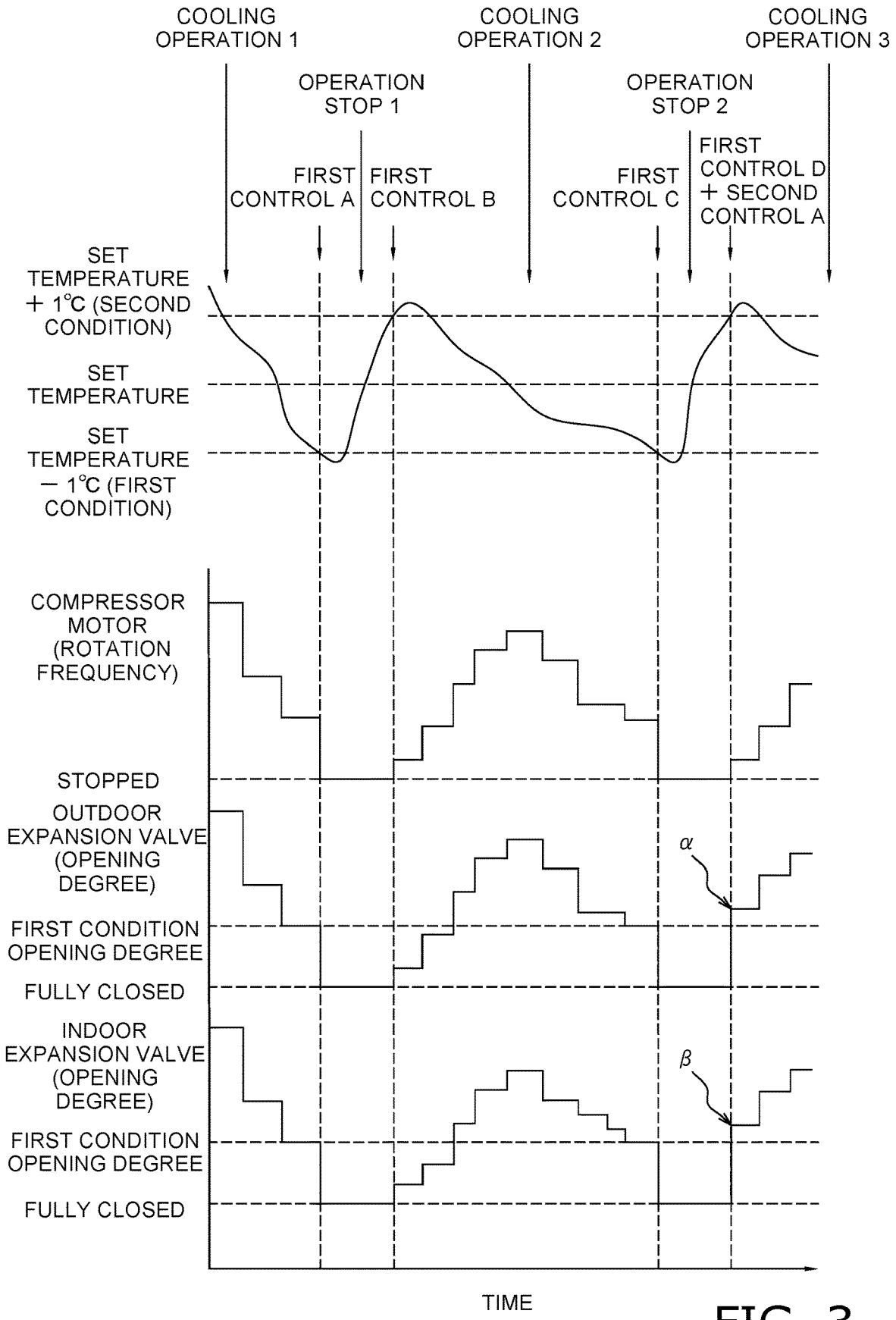
FIG. 3 includes graphs indicating exemplary behavior of each device upon first control and second control during cooling operation.

FIG. 3 includes graphs indicating exemplary behavior of each device upon the first control and the second control during cooling operation. FIG. 3 includes an upper graph having a time axis as a transverse axis and indicating transition of room temperature around set temperature in the target space. FIG. 3 includes a lower graph having a time axis as a transverse axis and indicating transition of the rotation frequency of the compressor motor 31*m* in the compressor 31 and transition of the opening degrees of the outdoor expansion valve 34 and the indoor expansion valve 23.

As indicated as "cooling operation 1" in FIG. 3, the control unit 70 stepwise decreases the rotation frequency of the compressor motor 31*m* and the opening degrees of the outdoor expansion valve 34 and the indoor expansion valve 23 as room temperature in the target space approaches set temperature due to cooling operation.

As indicated as "first control A" in FIG. 3, if room temperature in the target space is equal to or less than "set temperature−1° C." (if the first condition is satisfied), the control unit 70 executes the first control of stopping cooling operation. Specifically, the control unit 70 stops the compressor motor 31*m*, and brings each of the outdoor expansion valve 34 and the indoor expansion valve 23 into a fully closed state.

As indicated as "operation stop 1" in FIG. 3, room temperature in the target space increases while the control unit 70 stops cooling operation.

As indicated as "first control B" in FIG. 3, if room temperature in the target space is equal to or more than "set temperature+1° C." (if the second condition is satisfied), the control unit 70 executes the first control of starting cooling operation. Specifically, as indicated as "cooling operation 2", the control unit stepwise increases the rotation frequency of the compressor motor 31*m* and the opening degrees of the outdoor expansion valve 34 and the indoor expansion valve 23. In this case, the control unit 70 increases the opening degree of each of the outdoor expansion valve 34 and the indoor expansion valve 23 from the fully closed state.

As indicated as "cooling operation 2" in FIG. 3, the control unit 70 stepwise decreases the rotation frequency of the compressor motor 31*m* and the opening degrees of the outdoor expansion valve 34 and the indoor expansion valve 23 as room temperature in the target space approaches set temperature due to cooling operation.

As indicated as "first control C" in FIG. 3, if room temperature in the target space is equal to or less than "set temperature−1° C." (if the first condition is satisfied), the control unit 70 executes the first control of stopping cooling operation. Specifically, the control unit 70 stops the compressor motor 31*m*, and brings each of the outdoor expansion valve 34 and the indoor expansion valve 23 into the fully closed state.

(2-3-3-2) First Control During Heating Operation

Figure 4:
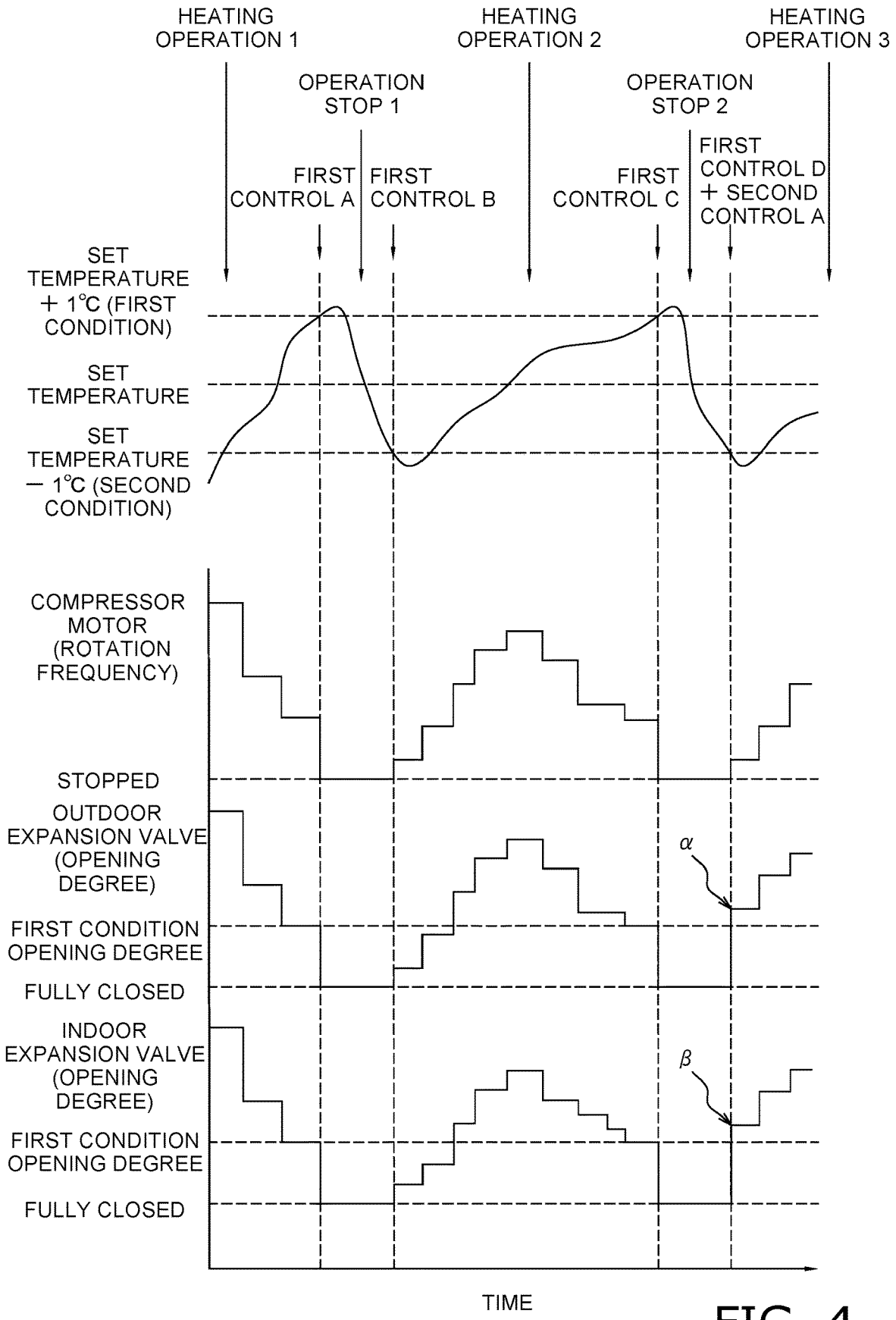
FIG. 4 includes graphs indicating exemplary behavior of each device upon the first control and the second control during heating operation.

FIG. 4 includes graphs indicating exemplary behavior of each device upon the first control and the second control during heating operation. FIG. 4 includes an upper graph having a time axis as a transverse axis and indicating transition of room temperature around set temperature in the target space. FIG. 4 includes a lower graph having a time axis as a transverse axis and indicating transition of the rotation frequency of the compressor motor 31*m* in the compressor 31 and transition of the opening degrees of the outdoor expansion valve 34 and the indoor expansion valve 23.

As indicated as "heating operation 1" in FIG. 4, the control unit 70 stepwise decreases the rotation frequency of the compressor motor 31*m* and the opening degrees of the outdoor expansion valve 34 and the indoor expansion valve 23 as room temperature in the target space approaches set temperature due to heating operation.

As indicated as "first control A" in FIG. 4, if room temperature in the target space is equal to or more than "set temperature+1° C." (if the first condition is satisfied), the control unit 70 executes the first control of stopping heating operation. Specifically, the control unit 70 stops the compressor motor 31*m*, and brings each of the outdoor expansion valve 34 and the indoor expansion valve 23 into the fully closed state.

As indicated as "operation stop 1" in FIG. 4, room temperature in the target space decreases while the control unit 70 stops heating operation.

As indicated as "first control B" in FIG. 4, if room temperature in the target space is equal to or less than "set temperature−1° C." (if the second condition is satisfied), the control unit 70 executes the first control of starting heating operation. Specifically, as indicated as "heating operation 2", the control unit stepwise increases the rotation frequency of the compressor motor 31*m* and the opening degrees of the outdoor expansion valve 34 and the indoor expansion valve 23. In this case, the control unit 70 increases the opening degree of each of the outdoor expansion valve 34 and the indoor expansion valve 23 from the fully closed state.

As indicated as "heating operation 2" in FIG. 4, the control unit 70 stepwise decreases the rotation frequency of the compressor motor 31*m* and the opening degrees of the outdoor expansion valve 34 and the indoor expansion valve 23 as room temperature in the target space approaches set temperature due to heating operation.

As indicated as "first control C" in FIG. 4, if room temperature in the target space is equal to or more than "set temperature+1° C." (if the first condition is satisfied), the control unit 70 executes the first control of stopping heating operation. Specifically, the control unit 70 stops the compressor motor 31*m*, and brings each of the outdoor expansion valve 34 and the indoor expansion valve 23 into the fully closed state.

(2-3-4) Second Control

The second control includes setting the opening degrees of the outdoor expansion valve 34 and the indoor expansion valve 23 upon a start of cooling operation or heating operation according to the first control to be larger than the opening degrees upon satisfaction of the first condition. According to the present embodiment, the outdoor expansion valve 34 and the indoor expansion valve 23 upon a start of cooling operation or heating operation during the second control have opening degrees obtained by increasing by a predetermined rate the opening degrees upon satisfaction of the first condition. The predetermined rate is exemplarily 30%. The second control may be executed after cooling operation or heating operation is stopped and started in accordance with the first control repeatedly a predetermined number of times within a predetermined time period. For example, the second control may be executed after cooling operation or heating operation is stopped and started in accordance with the first control repeatedly five times within thirty minutes.

(2-3-4-1) First Control and Second Control During Cooling Operation

As indicated as "operation stop 2" in FIG. 3, room temperature in the target space increases while the control unit 70 stops cooling operation.

As indicated as "first control D+second control A" in FIG. 3, if room temperature in the target space reaches "set temperature+1° C." (if the second condition is satisfied), the control unit 70 starts the first control and the second control of starting cooling operation. Specifically, as indicated as "cooling operation 3", the control unit stepwise increases the rotation frequency of the compressor motor 31*m* and the opening degrees of the outdoor expansion valve 34 and the indoor expansion valve 23. In this case, the control unit 70 increases the opening degrees of the outdoor expansion valve 34 and the indoor expansion valve 23 from the opening degrees (at a and R points in FIG. 3) obtained by increasing by the predetermined rate the opening degrees upon satisfaction of the first condition.

(2-3-4-2) First Control and Second Control During Heating Operation

As indicated as "operation stop 2" in FIG. 4, room temperature in the target space decreases while the control unit 70 stops heating operation.

As indicated as "first control D+second control A" in FIG. 4, if room temperature in the target space reaches "set temperature−1° C." (if the second condition is satisfied), the control unit 70 starts the first control and the second control of starting heating operation. Specifically, as indicated as "heating operation 3", the control unit stepwise increases the rotation frequency of the compressor motor 31*m* and the opening degrees of the outdoor expansion valve 34 and the indoor expansion valve 23. In this case, the control unit 70 increases the opening degrees of the outdoor expansion valve 34 and the indoor expansion valve 23 from the opening degrees (at the a and § points in FIG. 4) obtained by increasing by the predetermined rate the opening degrees upon satisfaction of the first condition.

(3) Processing

Figure 5:
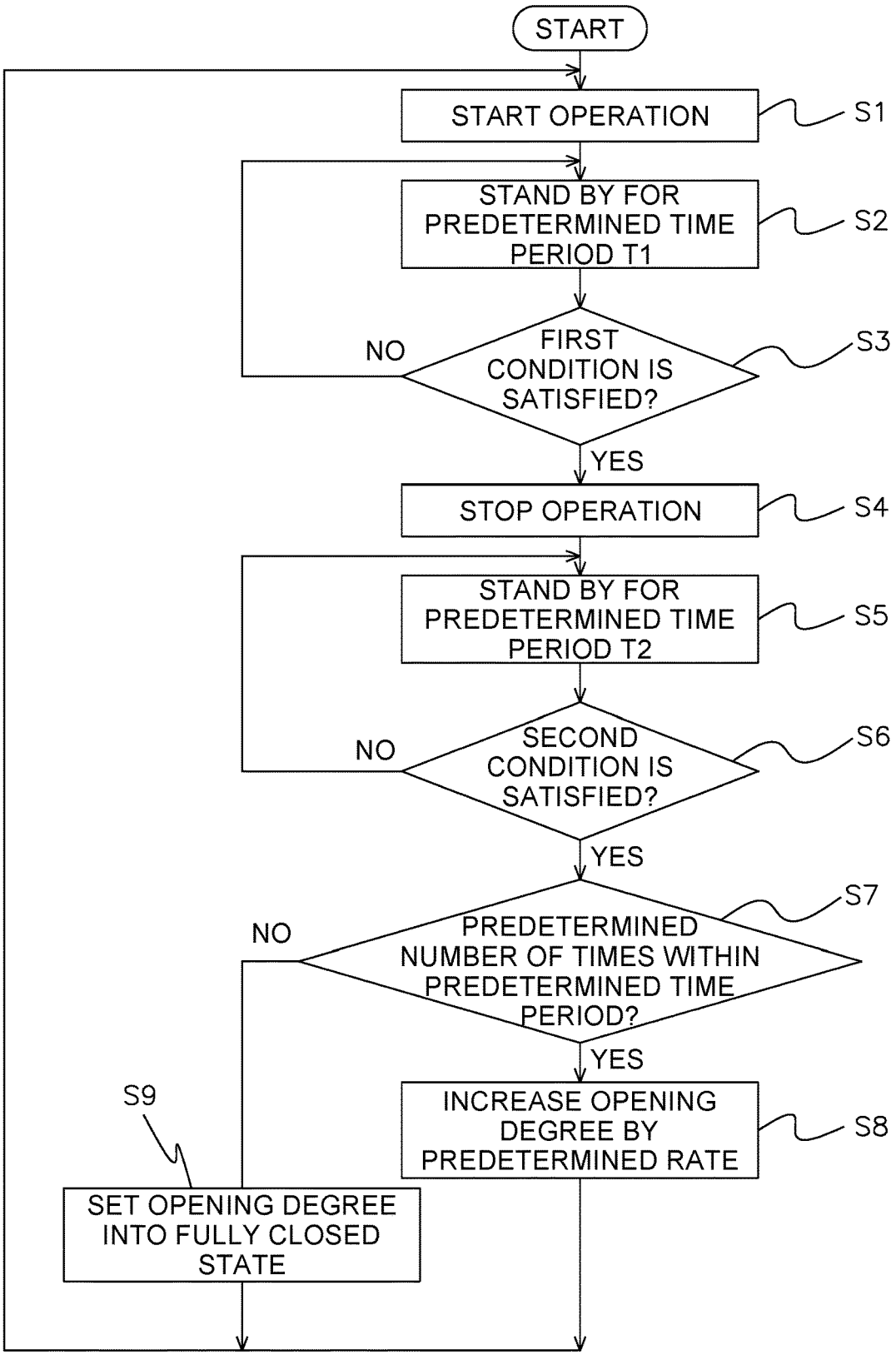
FIG. 5 is an explanatory flowchart of processing upon the first control and the second control during cooling operation or heating operation.

Processing of the first control and the second control during cooling operation or heating operation is exemplarily described with reference to a flowchart in FIG. 5.

As in step S1, the control unit 70 starts cooling operation or heating operation in accordance with a command from the operation remote controller or the like.

When the processing proceeds from step S1 to step S2, the control unit 70 stands by for a predetermined time period T1. The predetermined time period T1 is exemplarily five minutes.

When the processing proceeds from step S2 to step S3, the control unit 70 determines whether or not the first condition is satisfied. The processing proceeds to step S4 if the first condition is satisfied. If the first condition is not satisfied, the processing returns to step S2 and the control unit 70 stands by for the predetermined time period T1 again. In other words, the control unit 70 determines whether or not the first condition is satisfied every time the predetermined time period T1 elapses.

When the processing proceeds from step S3 to step S4, the control unit 70 stops cooling operation or heating operation.

When the processing proceeds from step S4 to step S5, the control unit 70 stands by for a predetermined time period T2. The predetermined time period T2 is exemplarily five minutes.

When the processing proceeds from step S5 to step S6, the control unit 70 determines whether or not the second condition is satisfied. The processing proceeds to step S7 if the second condition is satisfied. If the second condition is not satisfied, the processing returns to step S5 and the control unit 70 stands by for the predetermined time period T2 again. In other words, the control unit 70 determines whether or not the second condition is satisfied every time the predetermined time period T2 elapses.

When the processing proceeds from step S6 to step S7, the control unit 70 determines whether or not cooling operation or heating operation is stopped and started in accordance with the first control repeatedly a predetermined number of times within a predetermined time period. If a stop and a start are repeated the predetermined number of times within the predetermined time period, the processing proceeds to step S8. If a stop and a start are not repeated the predetermined number of times within the predetermined time period, the processing proceeds to step S9.

When the processing proceeds from step S7 to step S8, the control unit 70 sets the opening degrees of the outdoor expansion valve 34 and the indoor expansion valve 23 by increasing by a predetermined rate the opening degrees upon satisfaction of the first condition (with the second control), and starts cooling operation or heating operation (the processing returns to step S1).

When the processing proceeds from step S7 to step S9, the control unit 70 fully closes the opening degrees of the outdoor expansion valve 34 and the indoor expansion valve 23 (without the second control), and starts cooling operation or heating operation (the processing returns to step S1).

The control unit 70 continuously executes such processing until cooling operation or heating operation is stopped in accordance with a command from the operation remote controller or the like.

(4) Characteristics (4-1)

There has been conventionally provided the technique of stopping ongoing cooling operation or heating operation when the heat load in the target space decreases, and then starting cooling operation or heating operation in accordance with the heat load in the target space.

However, when cooling operation or heating operation starts in a state where a flow rate control mechanism is closed after cooling operation or heating operation stops, it takes time until the flow rate control mechanism has an appropriate opening degree and operation efficiency deteriorates.

The air conditioner 1 according to the present embodiment includes the indoor unit 20, the outdoor unit 30, the outdoor expansion valve 34, the indoor expansion valve 23, and the control unit 70. The indoor unit 20 is disposed in the target space of air conditioning. The outdoor unit 30 is disposed outside the target space. The outdoor expansion valve 34 and the indoor expansion valve 23 control a flow rate of a refrigerant. The control unit 70 executes cooling operation or heating operation, the first control, and the second control. Cooling operation or heating operation includes circulating the refrigerant in the indoor unit 20 and the outdoor unit 30 to approach room temperature in the target space to set temperature. The first control includes stopping cooling operation or heating operation if the first condition is satisfied during cooling operation or heating operation, and then starting cooling operation or heating operation if the second condition is satisfied. The first condition indicates that a heat load in the target space is low. The second condition relates to the heat load in the target space. The second control includes setting the opening degrees of the outdoor expansion valve 34 and the indoor expansion valve 23 upon a start of cooling operation or heating operation according to the first control to be larger than the opening degrees upon satisfaction of the first condition.

The air conditioner 1 according to the present embodiment sets the opening degrees of the outdoor expansion valve 34 and the indoor expansion valve 23 upon a start of cooling operation or heating operation to be larger than the opening degrees upon satisfaction of the first condition. The air conditioner 1 thus starts cooling operation or heating operation in the state where the outdoor expansion valve 34 and the indoor expansion valve 23 are opened, for preventing deterioration in operation efficiency.

(4-2)

In the air conditioner 1 according to the present embodiment, the first condition and the second condition are based on the temperature difference between the set temperature and the room temperature in the target space. The air conditioner 1 can thus accurately obtain the heat load in the target space.

(4-3)

In the air conditioner 1 according to the present embodiment, the second control is executed after cooling operation or heating operation is stopped and started in accordance with the first control repeatedly the predetermined number of times within the predetermined time period.

The air conditioner 1 according to the present embodiment executes the second control at a low load of a case where cooling operation or heating operation is stopped and started repeatedly the predetermined number of times within the predetermined time period. The air conditioner 1 can thus reduce a load of the compressor 31.

(4-4)

In the air conditioner 1 according to the present embodiment, the outdoor expansion valve 34 and the indoor expansion valve 23 upon a start of cooling operation or heating operation during the second control have the opening degrees obtained by increasing by the predetermined rate the opening degrees upon satisfaction of the first condition. The air conditioner 1 can thus start operation more efficiently.

(5) Modification Examples (5-1) Modification Example 1A

The air conditioner 1 according to the present embodiment includes the single indoor unit 20. The air conditioner 1 may alternatively include more than one indoor unit 20. In this case, the control unit 70 controls behavior of the indoor expansion valve 23 according to the first control and the second control for each of the indoor units 20, for example. Furthermore, the control unit 70 controls behavior of the compressor 31 and the outdoor expansion valve 34 in accordance with the first control and the second control along with the indoor unit 20 lastly stopping cooling operation or heating operation in accordance with the first control (as a result, all the indoor units 20 are stopped in accordance with the first control) and the indoor unit 20 initially starting cooling operation or heating operation in accordance with the first control (the remaining indoor unit 20 are stopped in accordance with the first control).

(5-2) Modification Example 1B

The air conditioner 1 according to the present embodiment is a so-called multiple air conditioning system for buildings, including the indoor units 20 each provided with the indoor expansion valve 23. The air conditioner 1 may alternatively a room air conditioner for household use, including the indoor unit 20 provided with no indoor expansion valve 23.

(5-3) Modification Example 1C

According to the present embodiment, the outdoor expansion valve 34 and the indoor expansion valve 23 upon a start of cooling operation or heating operation during the second control have the opening degrees obtained by increasing by the predetermined rate the opening degrees upon satisfaction of the first condition.

Alternatively, the outdoor expansion valve 34 and the indoor expansion valve 23 upon a start of cooling operation or heating operation during the second control may have the opening degrees of a case where the temperature difference between the set temperature and the room temperature in the target space reaches a predetermined value before satisfaction of the first condition. For cooling operation, the predetermined value is exemplarily 0.5° C. (room temperature in the target space−set temperature).

The air conditioner 1 can thus start operation more efficiently.

(5-4)

The embodiments of the present disclosure have been described above. Various modifications to modes and details should be available without departing from the object and the scope of the present disclosure recited in the patent claims.

REFERENCE SIGNS LIST

1: air conditioner
20: indoor unit
30: outdoor unit
23: indoor expansion valve (flow rate control mechanism)
34: outdoor expansion valve (flow rate control mechanism)
70: control unit

CITATION LIST

Patent Literature

Patent Literature 1: JP 2020-051700 A

The invention claimed is:

1. An air conditioner comprising:

an indoor unit disposed in a target space of air conditioning;

an outdoor unit disposed outside the target space;

a valve configured to control a flow rate of a refrigerant; and a controller; wherein the controller executes a cooling operation or a heating operation of circulating the refrigerant in the indoor unit and the outdoor unit to approach room temperature in the target space to set temperature, first control of stopping the cooling operation or the heating operation upon satisfaction of a first condition indicating that a heat load in the target space is below a threshold during the cooling operation or the heating operation, and then starting the cooling operation or the heating operation upon satisfaction of a second condition relevant to the heat load in the target space, and second control of setting an opening degree of the valve upon a new start of the cooling operation or the heating operation according to the first control to be larger than an opening degree upon satisfaction of the first condition, and the second control is executed after the cooling operation or the heating operation is stopped and started in accordance with the first control repeatedly a predetermined number of times within a predetermined time period.

2. The air conditioner according to claim 1, wherein the first condition and the second condition are based on a temperature difference between the set temperature and the room temperature.

3. The air conditioner according to claim 1, wherein the valve upon a start of the cooling operation or the heating operation during the second control has an opening degree obtained by increasing by a predetermined rate the opening degree upon satisfaction of the first condition.

4. An air conditioner comprising:

an indoor unit disposed in a target space of air conditioning;

an outdoor unit disposed outside the target space;

a valve configured to control a flow rate of a refrigerant; and a controller; wherein the controller executes a cooling operation or a heating operation of circulating the refrigerant in the indoor unit and the outdoor unit to approach room temperature in the target space to set temperature, first control of stopping the cooling operation or the heating operation upon satisfaction of a first condition indicating that a heat load in the target space is below a threshold during the cooling operation or the heating operation, and then starting the cooling operation or the heating operation upon satisfaction of a second condition relevant to the heat load in the target space, and second control of setting an opening degree of the valve upon a new start of the cooling operation or the heating operation according to the first control to be larger than an opening degree upon satisfaction of the first condition, and the valve upon a start of the cooling operation or the heating operation during the second control has an opening degree of a case where a temperature difference between the set temperature and the room temperature reaches a predetermined value before satisfaction of the first condition.

5. The air conditioner according to claim 4, wherein the first condition and the second condition are based on a temperature difference between the set temperature and the room temperature.

* * * * *